US011707124B2

(12) United States Patent
Hsu

(10) Patent No.: US 11,707,124 B2
(45) Date of Patent: Jul. 25, 2023

(54) HAIR COMB

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 496 days.

(21) Appl. No.: 16/737,333

(22) Filed: Jan. 8, 2020

(65) Prior Publication Data

US 2020/0221847 A1 Jul. 16, 2020

(51) Int. Cl.
*A45D 24/02* (2006.01)
*A45D 2/02* (2006.01)

(52) U.S. Cl.
CPC ..... *A45D 2/02* (2013.01)

(58) Field of Classification Search
CPC ..... A46B 7/026; A46B 5/0025; A46B 5/0037; A46B 9/026; A46B 5/0041; A46B 5/0045; A46B 5/002; A46B 5/0033; A46B 9/023; A46B 2200/104; A45D 24/02; A45D 40/265; A45D 40/262
See application file for complete search history.

(56) References Cited

U.S. PATENT DOCUMENTS 1,840,246 A * 1/1932 Newman ..... A46B 7/06 15/167.1
2,685,703 A * 8/1954 Dellenbach ..... A46B 9/026 15/167.1
2,935,755 A * 5/1960 Leira ..... A46B 7/06 15/186
5,259,083 A * 11/1993 Stansbury, Jr. ..... A61C 17/32 15/22.1
6,308,717 B1 * 10/2001 Vrtaric ..... A46B 9/023 132/129
D820,602 S * 6/2018 Yoon ..... D4/138
D820,603 S * 6/2018 Yoon ..... D4/138
D834,332 S * 11/2018 Chen ..... D4/134
D895,300 S * 9/2020 Sun ..... D4/134
D900,481 S * 11/2020 Chen ..... D4/133
D913,703 S * 3/2021 Sze ..... D4/134
D934,571 S * 11/2021 Wang ..... D4/134
D939,221 S * 12/2021 Park ..... D4/138
2013/0206183 A1 * 8/2013 Shim ..... A46B 9/023 134/32
2016/0088925 A1 * 3/2016 Pfenniger ..... A46B 9/026 15/167.1
2019/0008267 A1 * 1/2019 Vrtaric ..... A46B 5/0037
2019/0231059 A1 * 8/2019 Sze ..... A46B 5/0033
(Continued)

*Primary Examiner* — Nicholas D Lucchesi
*Assistant Examiner* — Jennifer Gill
(74) *Attorney, Agent, or Firm* — Alan D. Kamrath; Karin L. Williams; Mayer & Williams PC

(57) ABSTRACT

A hair comb contains: a handle, a stepped body extending from a connection segment of the handle, multiple long columns and multiple short column which are separately arranged on the stepped body. A height of a respective one long column is different a height of a respective one short column. The stepped body includes an external surround portion, a middle surround portion, and an internal surround portion which have different heights respectively. Multiple gaps are defined among the external surround portion, the middle surround portion, and the internal surround portion. The multiple gaps includes multiple support portions formed in a vertical line so that the external surround portion, the middle surround portion, and the internal surround portion define the stepped body.

4 Claims, 5 Drawing Sheets

(56) References Cited

U.S. PATENT DOCUMENTS

| | | | | |
|---|---|---|---|---|
| 2020/0288851 | A1* | 9/2020 | Sze | A46B 9/023 |
| 2020/0359764 | A1* | 11/2020 | York | A46B 17/04 |
| 2021/0100348 | A1* | 4/2021 | Gemelli | A46B 5/02 |

* cited by examiner

HAIR COMB

FIELD OF THE INVENTION

The present invention relates to a hair comb which combs the hairs by using the multiple long columns and the multiple short columns, and the stepped body of the hair come is deformable and flexible to match with various users' heads.

BACKGROUND OF THE INVENTION

A conventional hair comb contains: a handle, a combining section extending from an end of the handle, and multiple spaced columns arranged on the combing section.

Another hair comb contains a handle and a combining portion extending from an end of the handle, and multiple vertical columns and horizontal columns separately arranged on the combing portion.

Another conventional hair comb contains: a handle, a combing section formed on the handle, and multiple spaced columns arranged on the combing section.

However, it is easy to tie users' hairs on the multiple vertical columns, the multiple horizontal columns, and the multiple spaced columns when combining the users' hairs. Furthermore, the users' hairs cannot be combed smoothly.

The present invention has arisen to mitigate and/or obviate the afore-described disadvantages.

SUMMARY OF THE INVENTION

The primary aspect of the present invention is to provide a hair comb which combs the hairs by using the multiple long columns and the multiple short columns, and the stepped body of the hair come is deformable and flexible to match with various users' heads.

Another aspect of the present invention is to provide a hair comb which combs the hairs by using the multiple long columns and the multiple short columns, and the hairs do not tie on the multiple long columns and the multiple short columns.

To obtain above-mentioned aspects, a hair comb provided by the present invention contains: a handle, a stepped body extending from a connection segment of the handle, multiple long columns and multiple short column which are separately arranged on the stepped body.

A height of a respective one long column is different a height of a respective one short column. The stepped body includes an external surround portion, a middle surround portion, and an internal surround portion which have different heights respectively.

Multiple gaps are defined among the external surround portion, the middle surround portion, and the internal surround portion. The multiple gaps includes multiple support portions formed in a vertical line so that the external surround portion, the middle surround portion, and the internal surround portion define the stepped body.

DETAILED DESCRIPTION OF THE PREFERRED EMBODIMENTS

Figure 1:
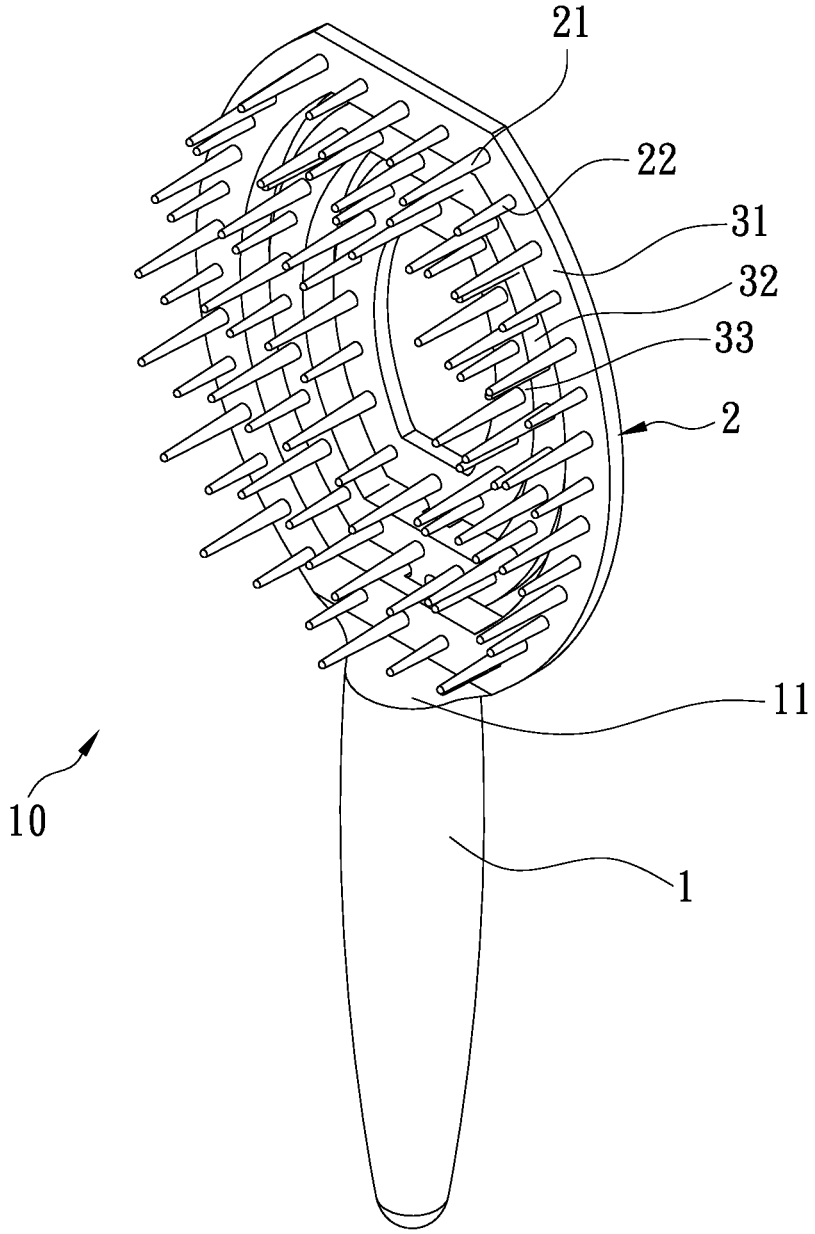
FIG. 1 is a perspective view showing the assembly of a hair comb according to a first embodiment of the present invention.
Figure 2:
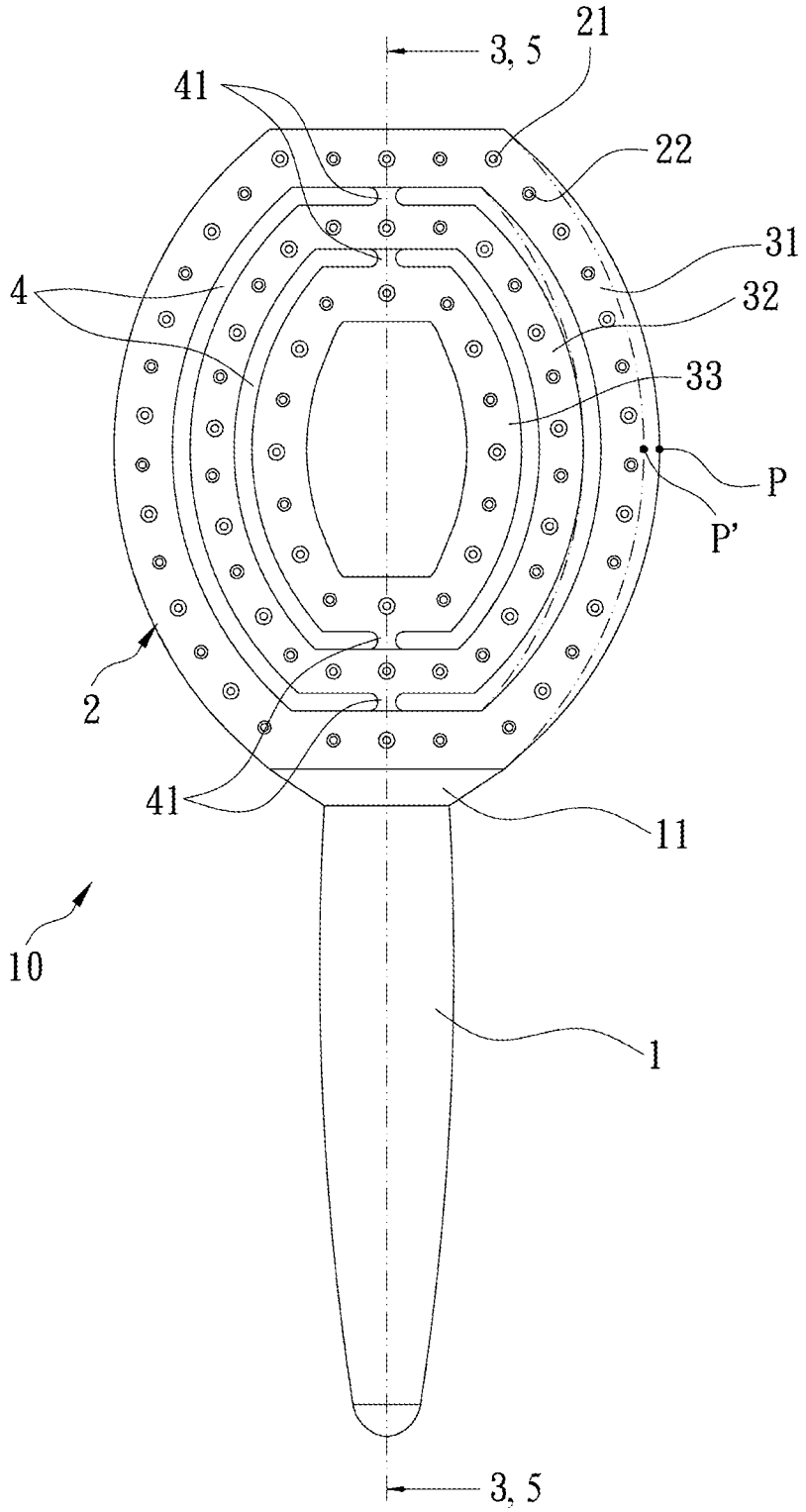
FIG. 2 is a side plan view showing the assembly of the hair comb according to the first embodiment of the present invention.
Figure 3:
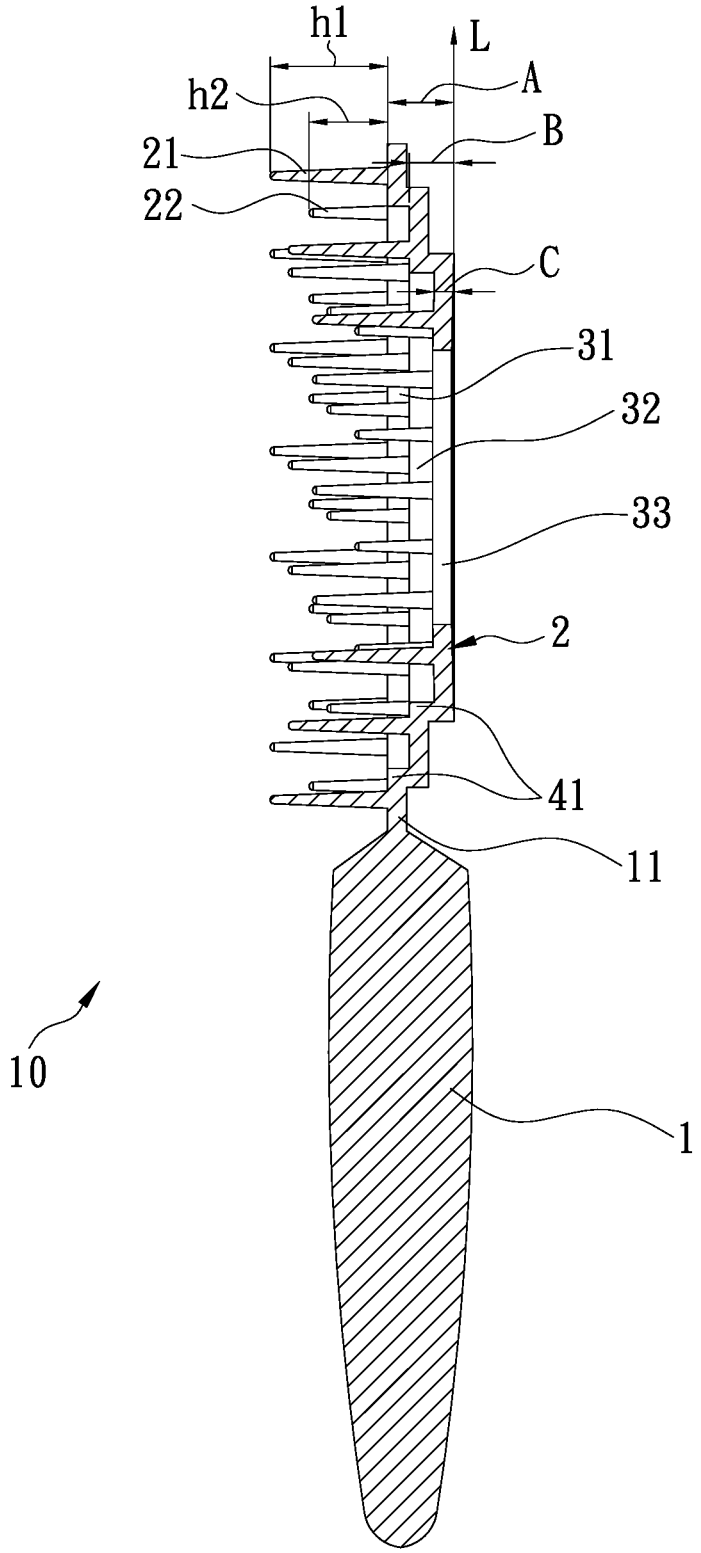
FIG. 3 is a cross sectional view showing the assembly of the hair comb according to the first embodiment of the present invention.

With reference to FIGS. 1-3, a hair comb 10 according to a first embodiment of the present invention comprises: a handle 1, a stepped body 2 extending from a connection segment 11 of the handle 1, multiple long columns 21 and multiple short column 22 which are separately arranged on the stepped body 2.

Referring to FIGS. 1-3, the stepped body 2 includes an external surround portion 31, a middle surround portion 32, and an internal surround portion 33 which have different heights respectively. As shown in FIG. 3, a bottom of the internal surround portion 33 is a datum line L, a first distance A is defined between the external surround portion 31 and the datum line L, a second distance B is defined between the middle surround portion 32 and the datum line L, and a third distance C is defined between the internal surround portion 33 and the datum line L, wherein the first distance A is more than the second distance B, and the second distance B is more than the third distance C.

Referring to FIG. 2, multiple gaps 4 are defined among the external surround portion 31, the middle surround portion 32, and the internal surround portion 33, and the multiple gaps 4 includes multiple support portions 41 formed in a vertical line V so that the external surround portion 31, the middle surround portion 32, and the internal surround portion 33 define the stepped body 2.

Figure 4:
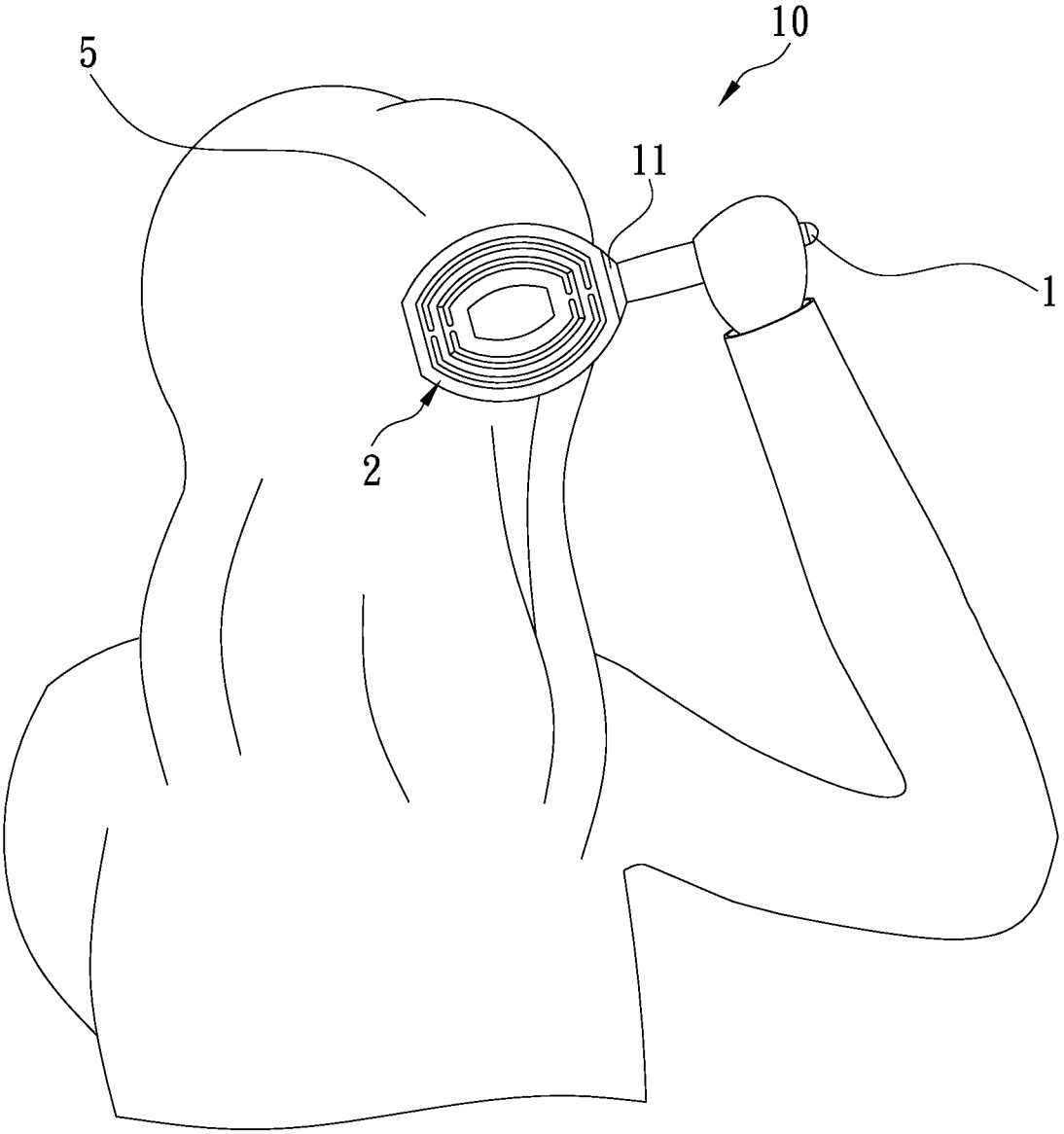
FIG. 4 is a side perspective view showing the application of the hair comb according to the first embodiment of the present invention.

As illustrated in FIG. 3, a height h1 of a respective one long column 21 is different a height h2 of a respective one short column 22, such that hairs of different lengths are combed by the multiple long columns 21 and the multiple short columns 22 smoothly, as shown in FIG. 4.

With reference to FIG. 4, the multiple long columns 21 and the multiple short columns 22 comb the hairs 5 completely, and the stepped body 2 matches with various users' heads. For example, as shown in FIG. 2, a position P of the external surround portion 31 is forced to change toward a position P', thus combing the hairs 5 matingly and smoothly. Preferably, the hairs do not tie on the multiple long columns 21 and the multiple short columns 22, and the middle surround portion 32 and the internal surround portion 33 are forced to change their positions so as to comb the hairs 5 easily. The external surround portion 31, the middle surround portion 32, and the internal surround portion 33 are flexible and deformable to match with the users' heads, and the hairs do not tie or are not broken on the multiple long columns 21 and the multiple short columns 22.

Figure 5:
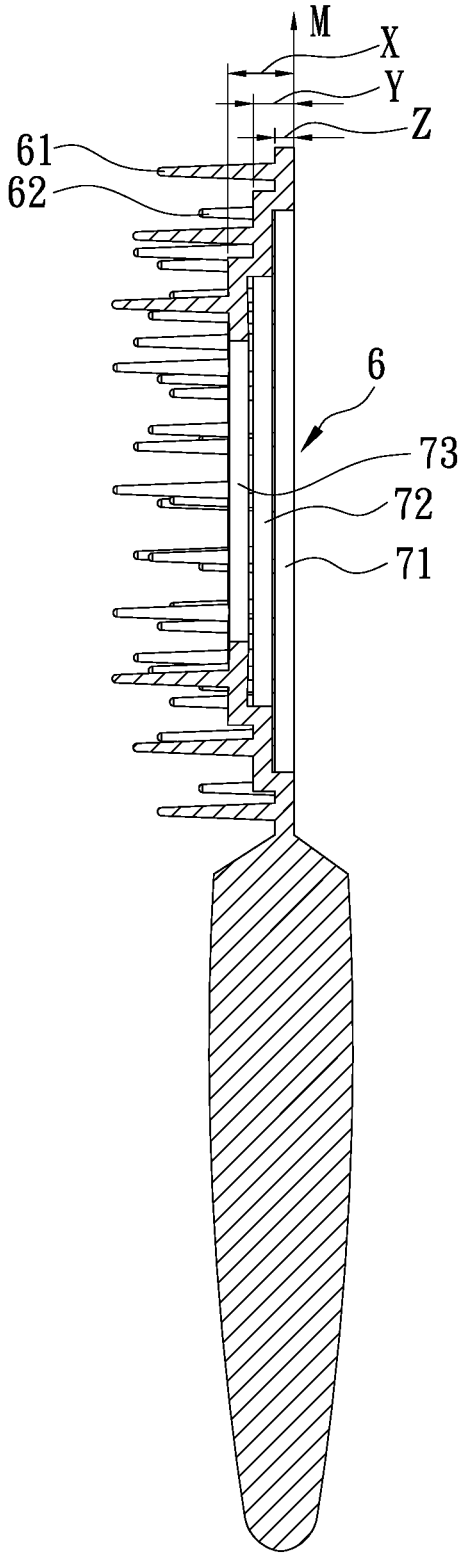
FIG. 5 is a cross sectional view showing the assembly of a hair comb according to a second embodiment of the present invention.

In a second embodiment, as shown in FIG. 5, a stepped body 6 includes an external surround portion 71, a middle surround portion 72, and an internal surround portion 73 which have different heights respectively, wherein a bottom of the external surround portion 73 is a datum line M, a first distance X is defined between the internal surround portion 73 and the datum line M, a second distance Y is defined between the middle surround portion 72 and the datum line M, and a third distance Z is defined between the internal surround portion 73 and the datum line M, wherein the first distance X is more than the second distance Y, and the second distance Y is more than the third distance Z. In addition, multiple long columns 61 and multiple short columns 62 are separately arranged on the external surround portion 71, the middle surround portion 72, and the internal surround portion 73 of the stepped body 6, wherein a height of a respective one long column 61 is different from a height of a respective one short column 62.

Thereby, the hairs are combed by the multiple long columns and the multiple short columns, and the stepped body is deformable and flexible to match with various users' heads. Preferably, the hairs do not tie on the multiple long columns and the multiple short columns.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A hair comb comprising:

a handle, a stepped body extending from a connection segment of the handle, wherein the stepped body includes an external surround portion, a middle surround portion concentric to the external surround portion, and an internal surround portion concentric to the middle surround portion, each of which have respective top surfaces at different vertical heights, and each of the external surround portion, middle surround portion, and internal surround portion lies in a single horizontal plane vertically offset from the others; a plurality of long columns and a plurality of short columns arranged on and vertically extending from the top surface of the external surround portion of the stepped body, from the top surface of the middle surround portion of the stepped body and from the top surface of the internal surround portion of the stepped body;

wherein vertical heights of the long columns are greater than vertical heights of the short columns;

wherein a plurality of gaps are defined between the external surround portion, the middle surround portion, and the internal surround portion, and a plurality of support portions connect the external surround portion to the middle surround portion, and the middle surround portion to the internal surround portion to define the stepped body, wherein the external surround portion is directly connected to the handle, and wherein the middle surround portion and the internal surround portion are not directly connected to the handle.

2. The hair comb as claimed in claim 1, wherein a bottom surface of the internal surround portion defines a datum line, a first distance is defined between the top surface of the external surround portion and the datum line, a second distance is defined between the top surface of the middle surround portion and the datum line, and a third distance is defined between the top surface of the internal surround portion and the datum line, wherein the first distance is more than the second distance, and the second distance is more than the third distance.

3. The hair comb as claimed in claim 1, wherein a bottom surface of the external surround portion defines a datum line, a first distance is defined between the top surface of the internal surround portion and the datum line, a second distance is defined between the top surface of the middle surround portion and the datum line, and a third distance is defined between the top surface of external surround portion and the datum line, wherein the first distance is more than the second distance, and the second distance is more than the third distance.

4. The hair comb as claimed in claim 1, wherein the support portions are aligned with each other.

* * * * *